US005318217A

United States Patent [19]

Stinson et al.

[11] Patent Number: 5,318,217

[45] Date of Patent: Jun. 7, 1994

[54] METHOD OF ENHANCING BOND JOINT STRUCTURAL INTEGRITY OF SPRAY CAST ARTICLE

[75] Inventors: Jonathan S. Stinson, Plymouth, Minn.; Kim E. Bowen, Whitehall, Mich.

[73] Assignee: Howmet Corporation, Greenwich, Conn.

[21] Appl. No.: 794,320

[22] Filed: Nov. 14, 1991

Related U.S. Application Data

[63] Continuation of Ser. No. 452,958, Dec. 19, 1989, abandoned.

[51] Int. Cl.[5] ..... B23K 20/16; B23K 20/24

[52] U.S. Cl. ..... 228/194; 228/209; 29/889.2; 29/889.1; 419/49

[58] Field of Search ..... 427/34; 419/8, 49; 228/194, 119, 209, 243; 29/889.1, 889.2

[56] References Cited

U.S. PATENT DOCUMENTS

| | | | |
|---|---|---|---|
| 3,839,618 | 10/1975 | Muehlberger | 219/121 P |
| 4,008,052 | 2/1977 | Vishnevsky et al. | 164/75 X |
| 4,096,615 | 6/1978 | Cross | 29/156.8 R |
| 4,270,256 | 6/1981 | Ewing | 29/156.8 R |
| 4,335,997 | 6/1982 | Ewing et al. | 416/185 |
| 4,418,124 | 11/1983 | Jackson et al. | 428/548 |
| 4,447,466 | 5/1984 | Jackson et al. | 427/34 |
| 4,529,452 | 7/1985 | Walker | 148/11.5 Q |
| 4,562,090 | 12/1985 | Dickson et al. | 427/34 |
| 4,581,300 | 4/1986 | Hoppin, III et al. | 428/546 |
| 4,596,718 | 6/1986 | Gruner | 427/34 |
| 4,659,288 | 4/1987 | Clark et al. | 416/186 |
| 4,705,203 | 11/1987 | McComas et al. | 228/119 |
| 4,878,953 | 11/1989 | Saltzman | 228/119 X |

OTHER PUBLICATIONS

S. Shankar et al., Vacuum Plasma Sprayed Metallic Coatings, Journal of Metals, 1981.

*Primary Examiner*—Peter A. Nelson

*Attorney, Agent, or Firm*—Flynn, Thiel, Boutell & Tanis

[57] ABSTRACT

In a method of making a load-bearing article by spray casting a molten metal onto a metal substrate, the substrate surface receiving the spray cast deposit is treated by vacuum cleaning, boronizing and/or knurling to enhance the structural integrity of the diffusion bond joint subsequently formed between the spray cast deposit and the substrate in sustaining a load across the joint without premature joint failure.

37 Claims, 4 Drawing Sheets

METHOD OF ENHANCING BOND JOINT STRUCTURAL INTEGRITY OF SPRAY CAST ARTICLE

This is a continuation of copending U.S. patent application Ser. No. 07/452,958 filed on Dec. 19, 1989, and now abandoned.

FIELD OF THE INVENTION

The present invention relates to processes for enhancement of the structural integrity of a metallurgical diffusion bond joint of a structural spray cast article wherein a solid metal substrate and a spray cast metal deposit are diffusion bonded together.

BACKGROUND OF THE INVENTION

Compressor and turbine rotors (or wheels) as well as centrifugal impellers used in gas turbine engines represent load-bearing components which would have an equiaxed fine grain microstructure in the hub-to-rim regions for optimum low cycle fatigue resistance at service temperature and an equiaxed cast grain, directionally solidified columnar grain or single crystal grain structure in the blades for optimum high temperature stress rupture strength at service temperature.

Although integrally cast bladed turbine rotors have been successfully used for years in many small gas turbine applications, the prior art has recognized that the conventional investment cast rotor inherently compromises the ideal microstructure described above. Namely, the relatively massive hub section of the casting exhibits a coarse, columnar grain structure due to its slower solidification and cooling after casting, while the rim section exhibits a finer, columnar grain structure. As a result of their thin section, the integrally cast blades exhibit a generally equiaxed, finer grain structure. The significance of such a compromise in the microstructure of the turbine rotor becomes apparent when it is recognized that the mechanical properties of the casting are a function of the number and orientation of the grains in the particular region of interest. For example, coarser grain structures are known to offer better elevated temperature stress rupture properties than a fine grain structure. However, the latter grain structure offers better low cycle fatigue properties. Moreover, the low cycle fatigue properties within a cast component depend on the crystallographic orientation of grains relative to the local distribution of stress(es). An unfavorably oriented coarse, columnar grain in a conventionally cast component can contribute to premature fatigue failure of the component.

An improved investment casting process, known as the Grainex® investment casting process, was developed to enhance the uniformity of the microstructure of integrally cast bladed rotors (specifically integral turbine wheels) to meet new challenges of component performance and reliability demanded by increased thrust and horsepower applications. The Grainex process includes motion of the mold during solidification of the melt and also, a post-casting HIP (hot isostatic pressing) treatment. This process develops a substantially uniform fine, equiaxed grain structure through the hub, web and rim regions of the casting. This microstructure provides a significant improvement in the low cycle fatigue properties in these sections of the cast turbine wheel while providing stress rupture properties in the blades similar to those obtainable in conventionally investment cast bladed rotors.

Another improved investment casting process, known as the MX® investment casting process, was also developed to enhance the uniformity of the microstructure of castings. The MX process involves filling a properly heated mold with molten metal having little superheat (e.g., within 20° F. of its measured melting temperature) and then solidifying the molten metal in the mold at a rate to form a casting having a substantially equiaxed cellular, non-dendritic microstructure uniformly throughout with attendant improvement in the mechanical properties of the casting.

Integrally bladed rotors have also been fabricated by machining processes which utilize either ingot or consolidated metal powder starting stock. The powder metal rotors are generally consolidated by hot isostatic processing (HIP) and demonstrate reduced alloy segregation compared to ingot metallurgy. Powder metal rotors are, however, susceptible to thermally induced porosity (TIP) from residual argon used in powder atomization. Any oxygen contamination of powders can form an oxide network resulting in metallographically detectable prior particle boundaries which are known sites of fracture initiation. These limitations make manufacture of rotors by machining of ingot or consolidated metal powder costly in terms of both processing and quality controls.

Advanced powder metal manufacturing and consolidating techniques coupled with advanced forging processes have provided the capability to produce fine grain rotors which exhibit improved low cycle fatigue properties as compared to conventional investment cast rotors. However, the forged rotors typically exhibit inferior stress rupture properties compared to conventional investment cast rotors.

Unfortunately, in general, metallurgical processing to maximize low cycle fatigue properties of a metal results in reduced creep (stress rupture) properties. As a result, in more demanding service applications where increased thrust and horsepower are required (e.g., in military aircraft), designers have often resorted to the traditional separately bladed/mechanical attachment approach that involves fabricating a fine-grained, forged disk; machining slots in the disk to accept machined blade roots; and inserting cast blades of the desired grain structure (e.g., directionally oriented or single crystal) into the slots. However, machining slots and blade roots are costly processing steps. This method also limits the number of blades that can be attached, especially in smaller engines. A design with a large number of blades often is desirable for higher performance.

Those skilled in the art of turbine engine design have recognized the potential advantages of combining the ease of fabrication and the structural integrity of monolithic integrally cast/forged rotors with the high performance capability obtainable in separately bladed turbine engine rotors. Several approaches have been developed to produce such a turbine rotor. One such approach is illustrated in U.S. Pat. No. 4,096,615 wherein an equiaxed blade ring is cast and then solid state diffusion bonded to a separately produced powder metal hub or disk in a hot isostatic pressing step. Both an interference fit and brazing are usually required to achieve complete bonding during HIP'ing. In particular, a radially inwardly facing surface of the blade ring is machined to precise diameter to form a bonding surface adapted to mate with the radially outwardly facing bonding surface of a hub or disk made of another material. The blade ring is positioned over the hub and oxygen and other contaminants are removed from the bonding surfaces by vacuum treatment, followed by sealing the external joint lines with braze material. Hot isostatic pressing is then used to diffusion bond the blade ring to the hub. This approach has the disadvantage of requiring several separate processes: (1) casting the blade ring; (2) precision machining the inner diameter of the blade ring; (3) powder metal HIP consolidation; (4) precision machining the outer diameter of the powder metal hub, (5) assembly of the blade ring and powder metal hub; and (6) a second HIP operation to achieve final solid state diffusion bonding. Each of these processes is expensive and may create additional costs arising from defect scrap losses.

U.S. Pat. No. 4,270,256 describes a somewhat similar process for making a hybrid turbine rotor wherein an expendable blade fixturing ring is used to position the blades for bonding directly to a hub in a hot isostatic pressing step. The blade fixturing ring is removed after the blades are bonded to the hub.

A similar, complex approach for manufacturing a dual-alloy integrally bladed rotor is illustrated in U.S. Pat. No. 4,529,452. In that approach, a blade ring is formed by diffusion bonding a plurality of single crystal elements together. The bonded blade ring is then bonded to a hub by a superplastic forming/solid state diffusion bonding step.

Another approach used in the art employs powder metal in an investment mold which has directionally solidified or single crystal cast blades positioned within it. The mold is loaded in a metal can, covered with an inert pressure-transmitting media, vacuum sealed and hot isostatically pressed. This combined blade/powder metal approach has less process steps than the interference fit approach described immediately above but is severely limited in dimensional control due to blade/-mold movement during consolidation of the 65–70% dense powder.

A relatively new low pressure, high velocity plasma spray method to produce fine grain, load-bearing structural components (as opposed to protective coatings on a component) is illustrated in U.S. Pat. Nos. 4,418,124 and 4,447,466. This low pressure, high velocity plasma spray method to produce structural components employs a spraying procedure described in U.S. Pat. No. 3,839,618. Attempts have been made to use the low pressure, high velocity plasma spray technique to fabricate dual alloy turbine wheels. In these attempts, a plasma gun in a dynamic partial vacuum (low pressure) is used to plasma spray molten metal onto a solid metal substrate in the form of an integrally bladed dish-shaped member. In particular, metal powder feedstock is injected into the plasma gun and propelled to the substrate in a carrier gas. A plasma jet deposits molten droplets of the spray cast metal on the surface of the solid substrate where the droplets solidify incrementally until the desired structural shape (e.g., a rotor hub preform) is obtained. The droplets are deposited by line-of-sight to produce simple near-net-shape configurations with a joint between the initial solid substrate (e.g., investment cast substrate) and the spray cast metal deposit. The spray cast deposit can be different in composition and/or microstructure from the initial solid substrate. After deposition of the spray cast metal, the preform is hot isostatically pressed (i.e., HIP'ed) to substantially eliminate voids primarily in the spray cast metal and diffusion bond the spray cast metal and solid substrate at the bond joint therebetween.

However, in attempts to utilize the low pressure plasma spray method to make dual alloy or dual property turbine wheels, prior art workers have found the diffusion bond joint to exhibit a lack of structural integrity as evidenced by an unexpectedly short life in elevated temperature stress rupture tests. In particular, premature planar failures (bondline fractures) solely through the bond joint have been observed in stress rupture tests where a load is applied across the joint at elevated temperature. In spite of various efforts to facilitate diffusion bonding between the spray cast metal and the metal substrate (the bladed component), the problem of inadequate bond joint structural integrity has persisted.

It is an object of the invention to overcome this problem and to so enhance the structural integrity of the diffusion bond joint formed between the spray cast metal and the solid substrate that premature bond joint failures in elevated temperature stress rupture tests (simulating intended service conditions) are reduced or substantially eliminated and result in acceptable bond joint life under both testing and service conditions.

It is another object of the invention to subject the metal substrate receiving the spray cast metal to surface treatment processes that can be used individually or in various combinations with subsequent hot isostatic compaction to enhance bond joint integrity depending upon the degree of compositional difference between the metal substrate and spray cast metal deposit bonded thereto.

It is still another object of the invention to provide such bond joint enhancement processes which overcome the many limitations/disadvantages associated with the other known methods of fabricating dual-property, diffusion bonded bladed rotors.

SUMMARY OF THE INVENTION

The invention envisions an improved method of making a structural (load-bearing), multi-property article wherein a molten metal is spray cast on a metal substrate and the spray cast metal deposit and the substrate are treated so as to form a metallurgical diffusion bond joint therebetween. In particular, the invention contemplates enhancing the structural integrity of the diffusion bond joint in sustaining a load thereacross in service without exhibiting failure solely in the metallurgical diffusion bond joint between the substrate and the deposit.

The invention contemplates subjecting the surface of the solid metal substrate to one or more surface treatments in selected sequence with low pressure, high velocity plasma spray casting of the molten metal thereon (either fully or partially molten droplets/particles) such that the surface treatments, preferably in conjunction with subsequent hot isostatic pressing of the substrate and spray cast deposit, enhance the structural integrity of the diffusion bond joint between the substrate and the spray cast deposit. The invention also contemplates employing the surface treatments individually or in various combinations depending on the degree of similarity or dissimilarity of the compositions of the spray cast metal and the substrate.

In a typical working embodiment of the invention for improving the structural integrity of the diffusion bond joint between a substrate and a spray cast deposit of dissimilar compositions (e.g., a dual alloy article), the method involves heating the substrate surface in the presence of a melting point depressant, preferably a boron-bearing layer at the substrate surface, such that an exposed in-situ liquid phase or layer is formed on the surface. The molten metal is then sprayed onto the exposed in-situ liquid phase to incrementally build-up a solidified spray cast deposit on the substrate surface. The spray cast deposit and the substrate are then hot isostatically pressed in such a manner as to enhance the as-sprayed metallurgical diffusion bond, preferably to the extent of promoting epitaxial grain growth across the interfacial bond region between the substrate and the spray cast deposit, to enhance the structural integrity of the metallurgical diffusion bond joint in sustaining a load thereacross without exhibiting failure solely in the bond joint and to fully densify the spray cast material. A structural, multi-property article is thereby formed in accordance with this working embodiment of the invention.

In a preferred practice of this working embodiment of the invention, the substrate surface is heated and then reverse arc cleaned to form the exposed in-situ liquid phase thereon acceptable for receiving the spray cast deposit. In another preferred embodiment, the substrate surface is knurled prior to applying the melting point depressant thereon. Knurling of the substrate surface forces any interfacial crack formed in proximity thereto in the structural article under loading to deviate from a strictly planar path, thereby requiring increased energy for the crack to propagate in the interfacial bond region between the bonded substrate and deposit of the article.

In another typical working embodiment of the invention for improving the structural integrity of the diffusion bond joint between a substrate and a spray cast deposit of the same or similar compositions, the method involves initially vacuum cleaning the substrate surface by exposure to a vacuum of at least $10^{-4}$ torr at a suitable elevated temperature prior to spray casting. Then, the substrate surface is heated and reverse arc cleaned in the spray chamber immediately prior to spray casting the molten metal thereon. The spray cast deposit and the substrate are thereafter hot isostatically pressed to provide the desired metallurgical diffusion bond joint therebetween to form the structural article.

In the embodiments of the invention described hereinabove, the substrate advantageously comprises an equiaxed, single crystal or directionally solidified columnar grain metal member while the spray cast deposit comprises an equiaxed fine grain microstructure.

In an exemplary embodiment of the invention, the equiaxed, single crystal or columnar grained metal member may comprise a bladed dish-shaped component of a turbine rotor while the fine grained spray cast deposit may comprise the hub of the turbine rotor. A multi-property structural article (e.g., turbine rotor) is thereby provided in accordance with the invention.

The invention is effective to improve the structural integrity of the metallurgical diffusion bond joint in such structural, multi-property articles. Preferably, the integrity of the diffusion bond joint is improved to such an extent that the bond joint can sustain a load thereacross under intended service conditions without exhibiting failure solely in the joint. That is, the bond joint is not a preferential failure site of such articles.

The aforementioned objects and advantages of the invention will become more apparent from the following detailed description taken with the drawings.

DETAILED DESCRIPTION OF THE INVENTION

The present invention will now be described in terms of certain embodiments that are illustrative of the invention.

The invention relates to a method of making a structural, multi-property article by spraying molten metal onto at least one solid metal substrate using low pressure, high velocity plasma spraying procedures similar to those described in U.S. Pat. Nos. 3,839,618; 4,418,124 and 4,447,466. The method finds particular utility in making structural, multi-property articles for service at high temperature and can be used to form metal articles having different microstructures in different locations. For example, a multiple property turbine wheel or rotor having a fine grained hub and single crystal, directionally solidified or cast equiaxed grain blades can be fabricated in accordance with the invention.

Although the detailed description and examples set forth hereinbelow are directed to manufacture of multi-property turbine wheels or rotors, the invention is not so limited and may be employed in the manufacture of myriad other structural, multi-property articles. Moreover, although the detailed description and examples set out hereinbelow are directed to nickel-base superalloys, the invention is not so limited and is operable with other superalloys as well as other metal and alloy systems that are capable of being formed into a molten metal spray and solidified to form a structural article that can have useful properties imparted thereto through appropriate thermal treatments.

Figure 1:
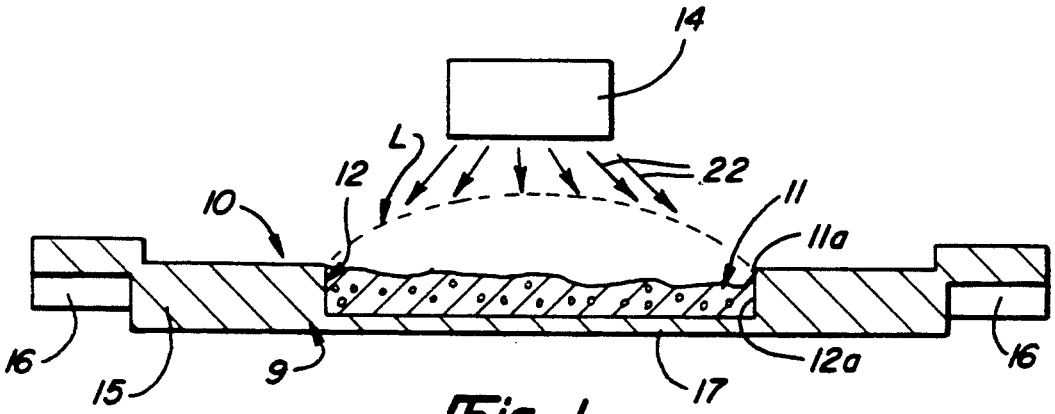
FIG. 1 is a schematic view of a solid metal substrate in the form of a bladed dish-shaped component, shown in section, and a plasma spray nozzle for spray casting molten metal in the cavity of the substrate.

In accordance with the invention, the first step of the method is to provide a solid metal substrate 10, see FIG. 1, adapted to both receive the molten metal being sprayed on its surface and to solidify the spray cast metal in the appropriate shape and microstructure.

As here embodied and depicted in FIG. 1, the solid metal substrate 10 preferably comprises a bladed dish-shaped component 9 of a turbine engine rotor. The bladed dish-shaped component 9 includes a cylindrical (or other shape) cavity 12 for receiving the spray cast metal deposit as described in detail hereinbelow. The cavity 12 is formed by a rim section 15 and a bottom wall 17. The bottom wall 17 as well as portions of the spray cast metal 11 are removed (e.g., machined off) in subsequent processing to yield the turbine rotor 20 (e.g., see FIGS. 2 and 3). The rim section 15 includes a plurality of circumferentially spaced apart integral blades 16 which may have a microstructure uniquely suited to the conditions imposed on the blades in service (e.g., the blades 16 may have an equiaxed, directionally solidified or single crystal microstructure depending upon the intended service conditions for the rotor 20). The cylindrical surface 12*a* of the cavity 12 receives the molten metal deposit 11 sprayed thereon from a plasma spray nozzle 14 (schematically depicted). The spray cast deposit 11 is built up above the cavity 12 to a level L (see phantom line in FIG. 1) such that the hub 18, FIGS. 2 and 3, can be machined from the deposit.

Figure 8:
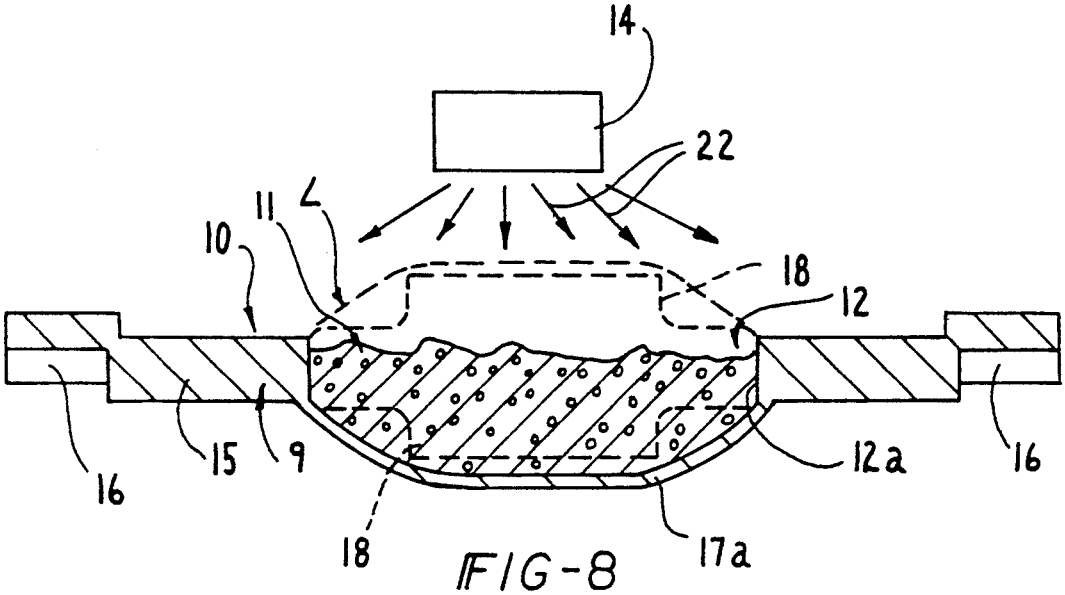
FIG. 8 is a schematic view similar to FIG. 1 of another embodiment of the invention.

Referring to FIG. 8 wherein like features of FIG. 1 are represented by like reference numerals, an alternate configuration for the bladed dish-shape component 9 of FIG. 1 is shown. Namely, the dish-shaped component 9 of FIG. 8 includes a downwardly bowed or arcuate, removable bottom wall 17*a* to receive sufficient spray cast metal 11 to be machined into a central hub 18 (see phantom lines) extending axially on opposite sides of the rim section 15.

Figure 2:
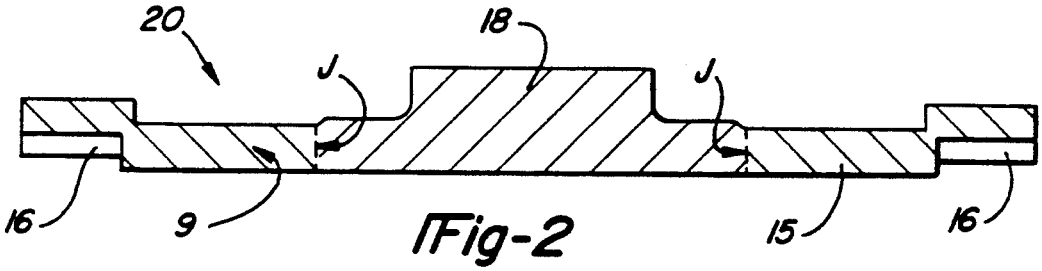
FIG. 2 is a schematic sectional view similar to FIG. 1 of the structural article (turbine wheel) formed by the method of the invention after machining the spray cast deposit to form a hub of a turbine wheel.

The invention envisions forming a metallurgical diffusion bond joint J, FIG. 2, of enhanced structural integrity between the metal substrate 10 (or bladed component 9) and the spray cast metal 11. A metallurgical diffusion bond joint is a continuous metallic structure of comingled atoms across the interface of the substrate 10 and the spray cast metal 11 being joined. The presence of epitaxial grain growth across the interface is considered to evidence a preferred, optimized metallurgical diffusion bond joint and to infer that the substrate surface 12*a* is atomically clean just prior to spraying of the spray cast metal 11 thereon.

Figure 3:
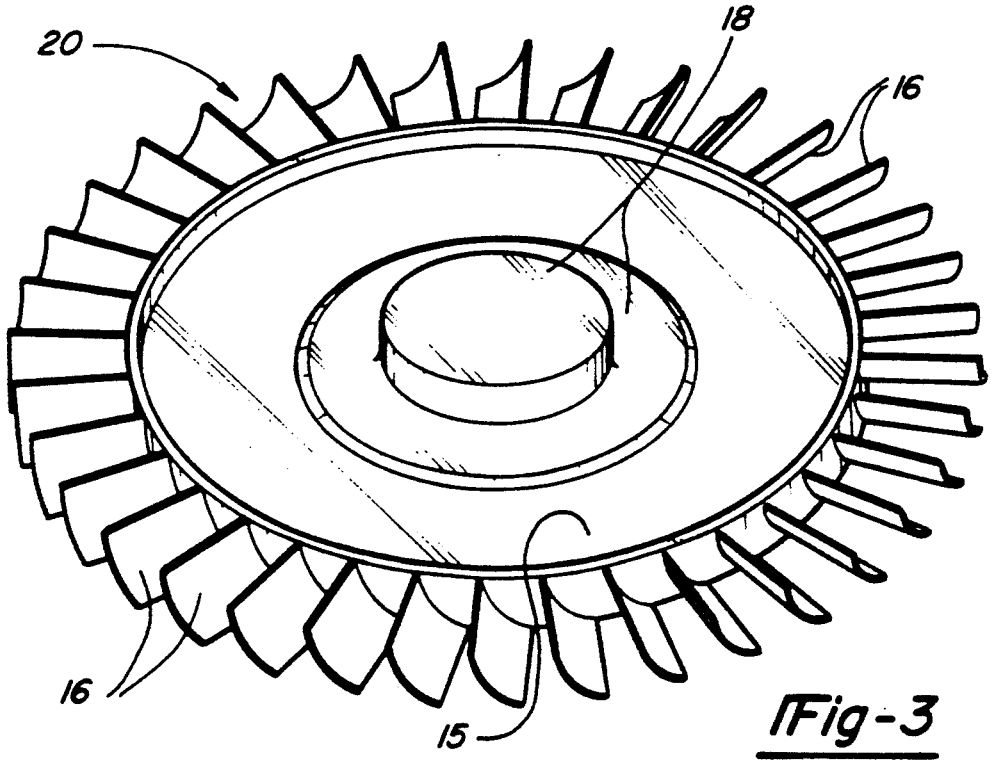
FIG. 3 is a perspective view of turbine wheel made in accordance with the invention.
Figure 4:
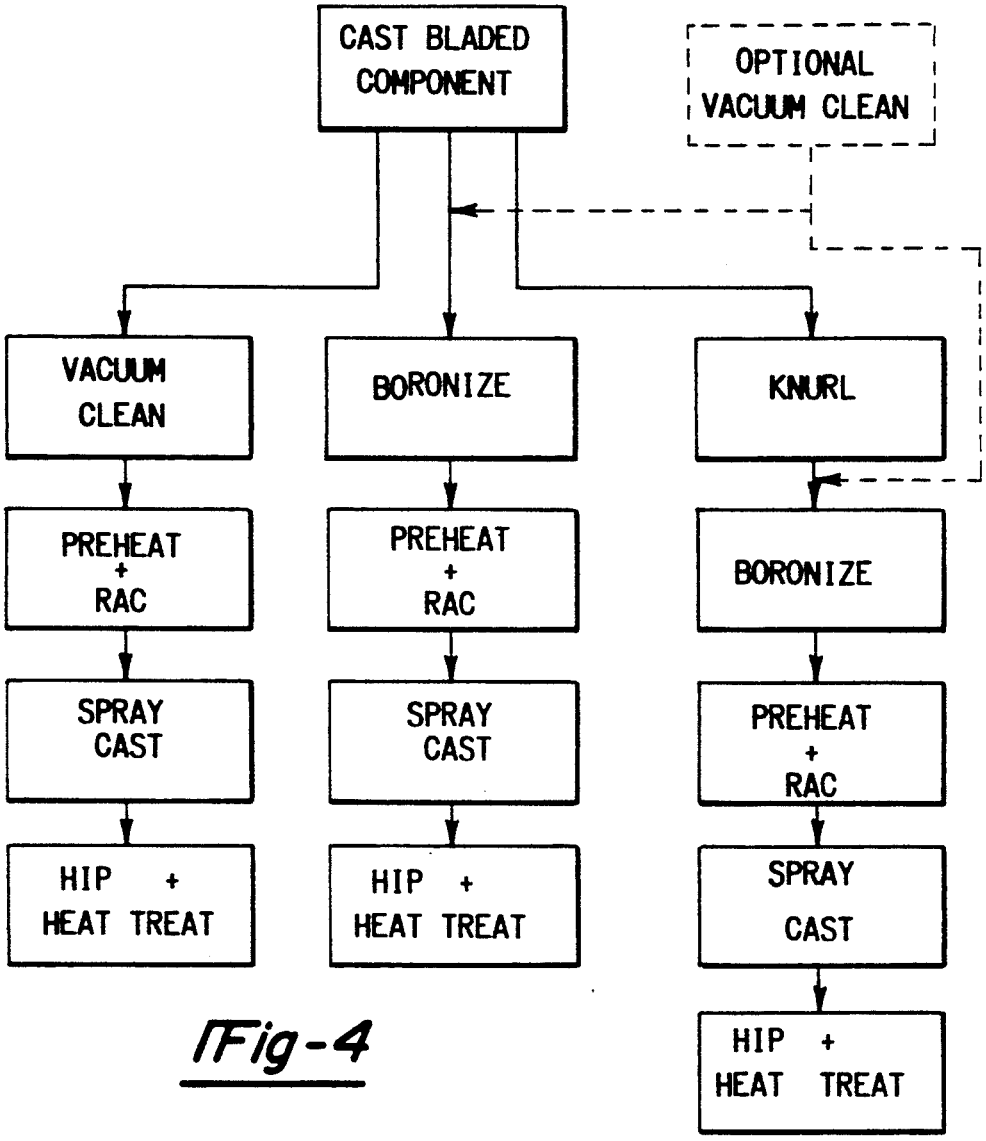
FIG. 4 is a process flow chart of the invention.

In FIGS. 2 and 3, the spray cast metal deposit 11 is shown machined to form the hub 18 of the gas turbine rotor 20. An axially-extending passage (not shown) may be ultimately machined in the hub 18 to receive the drive shaft of the gas turbine engine in known manner.

In accordance with the invention, the formation of a diffusion bond joint J of enhanced structural integrity between the surface 12*a* of the metal substrate 10 and the spray cast metal 11 is effected by applying one or more surface treatments (to be described) to the surface 12*a* of the cavity 12 in proper sequence with spray casting of the molten metal 11 thereon and subsequent hot isostatic pressing of the substrate and spray cast deposit. The intent of the surface treatments is to reduce and possibly eliminate the presence of certain tramp elements, such as S, Si, O, P, etc. in a substrate surface layer to hinder or prevent migration of such tramp elements to the substrate surface 12*a* and to the subsequently formed bond joint J during preheating of the substrate 10 prior to spray casting and during subsequent heating cycles. The invention involves the discovery that in structural spray cast articles made prior to this invention, such tramp elements were present at the bond joint J (as verified by Auger electron surface analysis) and adversely affected the bond joint structural integrity as measured by mechanical properties, specifically elevated temperature stress rupture properties.

The surface treatments of the present invention used to minimize the presence of these undesirable elements at the substrate surface 12*a* and at the diffusion bond joint J to enhance the bond joint integrity include the following:

(a) Vacuum cleaning the surface 12*a* at elevated temperature under a relatively hard vacuum; e.g., a vacuum of at least about $10^{-4}$ torr, preferably about $10^{-5}$ to about $10^{-6}$ torr, to vaporize the undesirable elements from the cavity surface 12*a*. The vacuum cleaning treatment typically involves positioning the substrate 10 in a vacuum furnace (not shown) and evacuating the furnace to at least about $10^{-4}$ torr, preferably $10^{-5}$ to $10^{-6}$ torr, while the substrate 10 is heated to a sufficiently high temperature, such as preferably greater than 2000° F. for nickel base superalloys, and for a sufficient time (e.g., 3 hours) to vaporize or otherwise remove the undesirable elements S, Si, O, P etc. from a surface layer of the cavity surface 12*a*. Typically after vacuum cleaning, the substrate is placed in a clean, sealed plastic bag for transport to the low pressure plasma spray chamber or, if the substrate is to be boronized (as will be described hereinafter) to a boronizing facility and thereafter to the low pressure plasma spray chamber.

(b) Boronizing of the substrate surface 12*a* to form, upon subsequent preheating and reverse arc cleaning, an exposed in-situ liquid phase or layer on the surface 12*a* at the onset of spray casting to receive the spray cast deposit and to prevent embrittlement at the interfacial region between surface 12*a* and the spray cast deposit 11 by oxygen and other tramp elements. During the molten stage, boron acts as a fluxing agent for the surface 12*a*. The in-situ molten layer acts to enhance bonding at the spray deposit-to-substrate interface by allowing liquid state diffusion kinetics to occur for some period of time. Such liquid state diffusion occurs at a rate approximately 100 times greater than solid state diffusion. The boron can be diffused into the substrate surface 12*a* to form a boron-bearing surface layer by various techniques, for example, by chemical vapor deposition or by over-the-pack gas phase deposition. The quantity of boron applied to the substrate surface 12*a* will depend on the compositions of the substrate metal and spray cast metal involved as well as the substrate temperature prior to spray casting. For nickel base superalloys to be preheated to about 2000° F. to about 2150° F. immediately prior to spray casting, the boron is applied (as applied by Materials Development Corp., Medford, Mass.) to the substrate surface 12*a* in the range of about 2 mg/in$^2$ (0.3 mg/cm$^2$) to about 17 mg/in$^2$ (2.6 mg/cm$^2$), preferably about 4 mg/in$^2$ (0.6 mg/cm$^2$) to about 6 mg/in$^2$ (0.9 mg/cm$^2$). In particular, the quantity of boron present and the temperature of the substrate 10 are selected to generate an exposed in-situ liquid phase at the onset of spray casting. This liquid phase has been found to enhance the metallurgical diffusion bond developed between the substrate 10 and the spray cast metal 11. The boron functions as a melting point depressant such that heating of the surface 12*a* to the selected preheat temperature effects incipient surface melting and fluxing of the substrate surface 12*a*.

Those skilled in the art will appreciate that selection of quantity of boron and the temperature of the substrate 10 for achieving incipient melting also will be a function of the composition of the substrate 10 and to some extent the configuration of the substrate 10. The desired substrate temperature can be obtained by preheating using a thermal plasma impinged on the substrate surface 12*a* followed by reverse arc cleaning of the substrate surface 12a as will be described hereinbelow. It is the reverse arc cleaning process which both cleans the substrate surface of oxide contamination formed during the preheat cycle, and provides the additional energy to form in-situ the exposed molten layer just before the onset of low pressure, high velocity plasma spray casting. That is, the surface energy input afforded by reverse arc cleaning causes the surface temperature to exceed the melting point of the boron alloyed surface layer, thereby allowing surface melting.

(c) Knurling the substrate surface 12a to render the interface convoluted rather than planar, thereby mechanically strengthening the metallurgical diffusion bond joint J by altering the path of propagation of any interfacial crack. Knurling of the substrate surface 12a can be employed in combination with the boronizing treatment (b) with or without the vacuum cleaning treatment (a) described hereinabove. If the vacuum cleaning treatment (a) is employed with the boronizing treatment (b), the substrate is knurled first and then subjected to the treatments (a) and (b) in succession.

Figure 6:
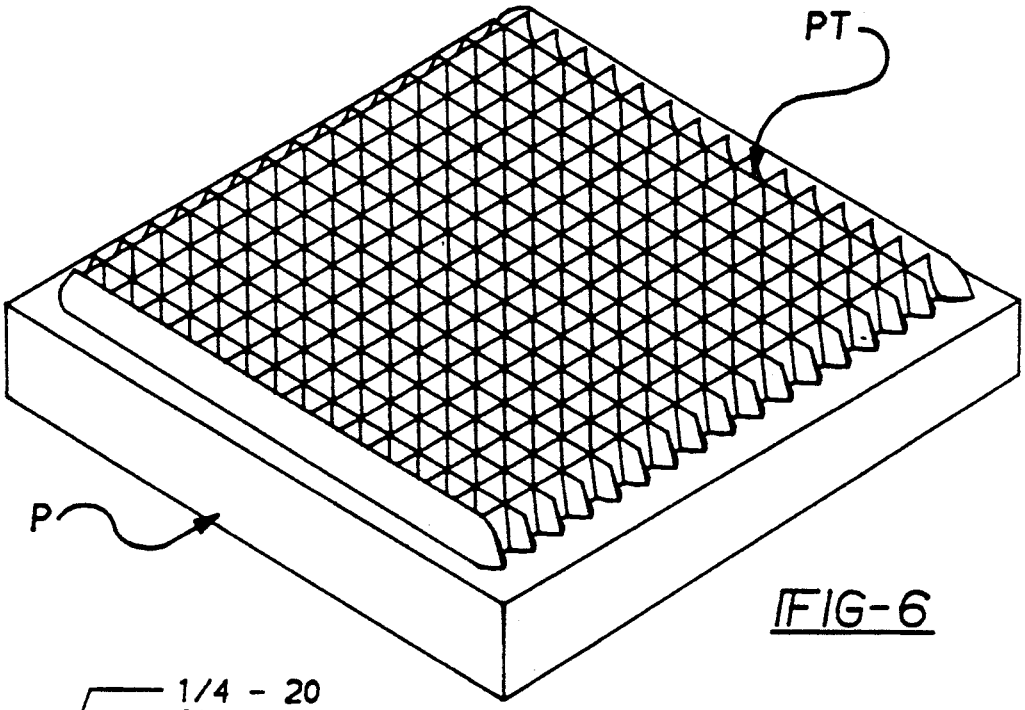
FIG. 6 is a perspective view of a plate specimen showing a typical pyramidal knurl pattern on the top surface adapted to receive the spray cast metal.

A typical pyramidal knurling pattern PT is shown in FIG. 6 for test specimens to be discussed hereinbelow. A spiral threaded knurling pattern as well as other knurling patterns characterized by surface apexes can also be used. Knurling of the substrate surface 12a can be effected by casting the surface with the desired features, machining the surface, rolling the surface 12a with a suitably configured forming die as well as other techniques. The end result or goal of the knurling pattern is to provide a convoluted substrate surface 12a with numerous apexes rather than planar characteristics. Typical dimensions of a pryamidal knurling pattern are set forth in the examples provided hereinbelow.

(d) Various combinations of treatments (a)–(c) set forth above can be used as desired to achieve the required enhancement of the structural integrity of the metallurgical diffusion bond joint J between the substrate 10 and the spray cast metal 11, for example, as measured by elevated temperature stress rupture tests.

With respect to treatments (a)–(d) set forth above, the present invention involves the further discovery that different surface treatments have different effects on bond joint structural integrity depending upon the similarity or dissimilarity of the compositions of the substrate metal and the spray cast metal. In particular, when the composition of the substrate metal and the spray cast metal are the same or similar, the vacuum cleaning treatment, alone, has been found to substantially enhance the structural integrity of the bond joint as illustrated in the examples set forth hereinbelow. On the other hand, for dissimilar compositions, the boronizing/heating treatment, with or without knurling, but with development of the exposed molten layer has been found to substantially enhance the structural integrity of the bond joint as illustrated in the examples set forth hereinbelow.

In accordance with the invention, the molten metal is sprayed onto the surface 12a of the solid (e.g., cast) metal substrate 10 after the surface 12a is subjected to one or more of the aforementioned surface treatments (a)–(d) referred to hereinabove depending upon the compositional similarities or dissimilarities between the substrate and the spray cast deposit, and after preheating and cleaning of the surface 12a as described hereinbelow.

As here embodied and depicted schematically in FIG. 1, there is provided a plasma spray nozzle 14 for projecting sprayed molten metal (represented by arrows 22) onto surface 12a of the cavity 12. Preferably, the molten metal 22 is sprayed by means of the introduction of metal powder (e.g., −325 mesh) into a high velocity thermal plasma. Particular success has been experienced using a plasma spray apparatus manufactured by Electro Plasma Inc., of Irvine, Calif. Such an apparatus generates a high temperature plasma of flowing inert gas. Solid metal powder is injected into and fully or partially melted by the high temperature plasma and the resulting fully or partially molten droplets/particles are projected, by movement of the plasma, toward the substrate surface 12a that is prepared to receive them. To ensure a uniform deposition of the sprayed molten metal onto the surface 12a of the solid metal substrate, the solid metal substrate 10 may be moved and/or the plasma gun indexed in order to impart a configuration to the deposited metal appropriate for the particular application. The spray cast metal 11 is adherent to the substrate surface 12a to form a preform comprising the spray cast metal 11 deposited and incrementally solidified onto the solid metal substrate 10. An as-sprayed metallurgical diffusion bond is formed between the substrate 10 and the spray cast deposit 11 as well as throughout the spray cast deposit 11.

As depicted in FIGS. 1 and 2, the nozzle 14 is in a fixed position with respect to the cavity 12 and the substrate 10 is rotated with respect to the nozzle 14 to deposit the metal 11 within and above the cavity 12 in the appropriate configuration (e.g., to level L). Where the cavity 12 receiving the molten metal 22 has an irregular configuration, it may be necessary to move both the solid metal substrate 10 as well as the nozzle 14 in order to minimize the formation of voids at the interface between the surface 12a and the spray cast metal 11. Because the process is conducted with a controlled inert atmosphere (e.g., Ar and He), the surface 12a of the cavity 12 and the surface of the spray cast deposit 11 should be free of surface contamination. A subsequent hot isostatic pressing operation is used to close any minor voids at the interface, fully densify the deposit 11 and enhance the as-sprayed metallurgical diffusion bond joint between the spray cast deposit 11 and the solid metal substrate 10.

In a preferred embodiment of the invention, prior to low pressure, high velocity spray casting in the spray chamber, the substrate 10 is preheated in the spray chamber in a controlled, low pressure atmosphere (Ar and He) by impingement with a thermal plasma and the substrate surface 12a is then immediately reverse arc cleaned (RAC'ed) in a thermal plasma. Preheating of the solid metal substrate affects the rate of heat transfer when the molten metal spray subsequently strikes the substrate surface 12a on which it is deposited. Because steep thermal gradients between the spray cast deposit and the substrate can result in residual stresses across their interface, the amount of preheating is controlled to minimize such gradients. For nickel-base alloys, preheating the solid metal substrate to a temperature in the range of from 2000° F. to 2200° F. is preferred. The solid metal substrate 10 can be preheated by means of the thermal plasma or other means (e.g., induction heating) prior to the deposition of the spray cast metal 11, thereby providing an efficient production process capable of being automated.

The reverse arc cleaning process is described in an article Journal of Metals, October 1981, authored by Shankar et al and involves forming a direct current arc with the substrate surface 12*a* as the cathode. Reverse arc cleaning removes surface impurities when conducted in a controlled atmosphere at low pressure as explained in copending U.S. patent application Ser. No. 173,468 of common assignee herewith, the teachings of which are incorporated herein by reference.

The spray chamber (not shown) receiving the substrate 10 is typically first evacuated to about 1–15 microns Hg, and then backfilled to 30–50 torr with Ar and He. The substrate 10 is then preheated to a desired preheat temperature by impinging a thermal plasma generated by the nozzle 14 on the surface 12*a*. Reverse arc cleaning (RAC) is carried out generally by maintaining the arc at about 100–250 amps between the spray nozzle gun (anode) and the substrate surface (cathode) 12*a* at a chamber pressure in the range of about 30 to about 70 torr. Both preheating and reverse arc cleaning are conducted in the controlled atmosphere of argon and helium. The substrate surface 12*a* can be preheated and then reverse arc cleaned (RAC) in multiple sequences prior to spray casting. However, only the final reverse arc clean (RAC) step (just prior to the onset of spray casting) should be allowed to form the exposed in-situ molten phase or layer when the substrate is boronized. The time of RAC can be used to control cleaning of the substrate surface 12*a* and uniformity of the molten layer formed.

The molten metal sprayed onto the substrate surface 12*a* is rapidly solidified because of the temperature differential between the sprayed molten metal and the solid metal substrate 10 even when the solid metal substrate 10 is preheated. This affords the opportunity to control the microstructure of the spray cast metal 11. By controlling the deposition rate onto the solid metal substrate, the gas pressure in the spray chamber, the velocity of the molten metal spray, and the temperature differential between the metal spray and the solid metal substrate, the grain size of the spray cast metal 11 can be varied and controlled. The molten metal solidifies incrementally to the solid metal substrate 10 and then to the previously deposited solidified spray cast metal 11 to build up the spray cast metal deposit on the substrate 10.

The spray cast metal 11 is subsequently rendered fully dense with a desired fine grain size (e.g., in the range of from ASTM 4 to ASTM 10) by appropriate thermal treatments. This grain size range generally meets the grain size requirements of the hub of turbine engine rotors.

In particular, after depositing the spray cast metal 11 on the substrate 10, the preform thusly formed is hot isostatically pressed to virtually eliminate any voids in the spray cast metal 11 and metallurgically diffusion bond the spray cast metal 11 and the surface 12*a* of the solid metal substrate 10. Hot isostatic pressing is preferably conducted in such a manner as to promote epitaxial grain growth across the interfacial bond region between the substrate surface 12*a* and the spray cast metal 11. As is well known, hot isostatic pressing is carried out under gas pressure thereby applying an isostatic pressure on the preform. After consolidation of the preform by hot isostatic pressing, the preform can be heat treated to obtain the desired mechanical properties for both the spray cast metal 11 and the solid metal substrate 10.

The process of the invention includes the formation during the final stages of spray casting of a gas impervious layer on the outermost surface (i.e., uppermost surface in FIG. 1) of the spray cast metal 11 to allow removal of residual microporosity by the subsequent hot isostatic pressing treatment. The gas impervious layer provides a means of transmitting the gas pressure during hot isostatic pressing to densify the spray cast metal 11 and eliminate any residual voids therein. Moreover, there will be a gas impervious bond between the outer exposed edge 11*a* of the spray cast metal 11, FIG. 1, and the cavity 12 shown so that gas pressure applied during hot isostatic pressing does not infiltrate to the interfacial region between the spray cast metal 11 and the cavity 12.

In general, the present invention is practiced with isostatic pressures of 15 to 25 KSI at temperatures of between about 1950° F. to about 2250° F. for about 2 to about 4 hours when the substrate and the spray cast metal are typical nickel base superalloys.

As mentioned hereinabove, the invention involves the discovery that the different surface treatments (a)–(d) described hereinabove have different effects on the structural integrity of structural spray cast articles depending upon the similarity or dissimilarity of the compositions of the substrate metal 10 and the spray cast metal 11. In particular, a set of preliminary tests was conducted to spray cast low carbon Astroloy (LC Astroloy) nickel base superalloy onto an investment cast Mar-M247 nickel base superalloy substrate as representative of dissimilar compositions. Another set of preliminary tests was conducted to spray cast LC Astroloy onto a LC Astroloy substrate as representative of the same or similar compositions. The LC Astroloy substrate itself had been spray cast and hot isostatically pressed under the same spraying and pressing conditions as described hereinafter for the specimens.

The following Table sets forth the compositions of superalloy specimens described hereinbelow in the examples.

TABLE

| | ALLOY COMPOSITIONS | | |
|---|---|---|---|
| Element | Cast IN713LC | VPSD* LC ASTROLOY | Cast MAR-M247 |
| Carbon | 0.06 | 0.03 | 0.16 |
| Chromium | 12.00 | 15.00 | 8.20 |
| Tungsten | — | — | 10.00 |
| Iron | — | — | — |
| Cobalt | 1.00 | 17.00 | 10.00 |
| Molybdenum | 4.30 | 5.00 | 0.60 |
| Aluminum | 5.80 | 4.00 | 5.50 |
| Titanium | 0.70 | 3.50 | 1.00 |
| Columbium | Cb + Ta | — | — |
| Tantalum | 2.00 | — | 3.00 |
| Zirconium | 0.06 | — | 0.05 |
| Boron | 0.007 | 0.020 | 0.015 |
| Vanadium | — | — | — |
| Hafnium | — | — | 1.50 |

*vacuum plasma structural deposition

Testing Of Dissimilar Compositions

For the test set involving the dissimilar compositions (i.e., LC Astroloy spray cast on Mar-M247), specimens were prepared (as described in detail hereinbelow) to investigate the effect of 1) vacuum cleaning, 2) heating a boronized substrate surface 12*a* and 3) knurling plus heating a boronized substrate surface 12*a* on the structural integrity of the bond joint J of structural spray cast specimens. In these tests, the investment cast Mar-M247 substrate comprised a generally flat, square plate of nominal 2 inches (5 cm) width, 2 inches (5 cm) length and ¾ inch (1.9 cm) thickness. A knurled specimen plate P is shown in FIG. 6.

The substrate surface 12a typically was solvent cleaned (e.g., using 1,1,1-trichloroethane and then Freon solvent) prior to vacuum cleaning and/or boronizing.

The LC Astroloy was spray cast to a thickness of about ¾ inch (1.9 cm) onto the Mar-M247 substrate plate as it was rotated with the nozzle 14 perpendicular to the substrate plate. The spray gun was translated relative to the rotating substrate to insure build-up of a uniform deposit in the cavity 12.

Prior to molten metal spraying, the specimen plate was low pressure plasma preheated (LPP) with the plasma gun at a chamber pressure of about 40 torr (Ar and He) with a gun power of approximately 70 KW until a surface temperature of 1000° F. was observed as indicated by the pyrometer. Then, the preheated specimen plate was low temperature reverse arc cleaned (LT RAC) at 1000° F. at about 125 amps until clean. For specimens that were previously boronized, no molten layer was formed during the LT RAC.

The LPP preheat of the specimen plate was continued at 50 torr until the temperature of the plate surface was about 2160° F. At about 2160° F., a high temperature reverse arc clean (HT RAC) was initiated. For specimens that were boronized, the HT RAC was maintained until the surface was observed to be clean (e.g., substantially free of any oxides formed during preheating) and a uniform molten surface layer was observed thereon. The HT RAC treatment provides the required surface energy input to clean the specimen and, if it is boronized, to also melt the boronized surface layer.

The HT RAC was turned off and powder feeding into the existing plasma plume was immediately started to impinge fully molten droplets on the plate surface with a spray chamber pressure of about 10 microns or less. A zero time lag between HT RAC "off" and powder feed "on" is desired.

Following plasma spraying the plate was cooled under a vacuum of less than 10 microns. The chamber was then argon backfilled to atmosphere prior to specimen removal.

After cooling, the spray cast preforms were hot isostatically pressed at 2165° F. and 25 KSI for 4 hours. Thereafter, the preforms were heat treated as follows: 2040° F. for 2 hours/AC (air cool)+1600° F. for 8 hours/AC+1800° F. for 4 hours/AC+1200° F. for 24 hours/AC+1400° F. for 8 hours/AC to ambient temperature.

Figure 7A:
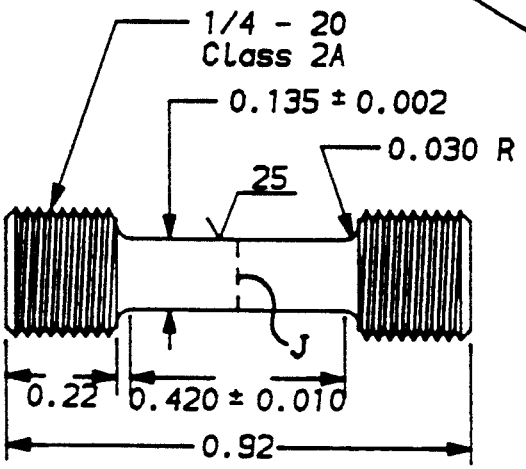
FIGS. 7A and 7B illustrate stress rupture test specimens (with dimensions shown) used in the examples set forth herein.

Table I sets forth 1400° F./80 ksi stress rupture test results for the surface treatments (a)–(d) of the invention described hereinabove for the aforementioned dissimilar compositions. The configuration of the stress rupture specimens is shown in FIG. 7A. The stress rupture specimens are machined from the center of the spray cast plates P with the longitudinal axis of the stress rupture specimens normal to the plate surface such that the diffusion bond joint is normal to the longitudinal axis of the stress rupture specimens (e.g., see FIG. 7A), and centered in the gage section.

The Group I specimens involved only vapor honing of the substrate surface 12a using commercially available alumina grit prior to preheating and reverse arc cleaning. The Group II specimens were vacuum cleaned in accordance with surface treatment (a) set forth above (e.g., vacuum level of at least $10^{-4}$ torr for 3 hours at 2150° F.). The specimens of Groups II and IV were boronized in accordance with surface treatment (b) set forth above; e.g., 4 mg/in$^2$ (0.6 mg/cm$^2$) to 17 mg/in$^2$ (2.6 mg/cm$^2$) boron was applied to the substrate surface 12a by Materials Development Corp., Medford, Mass. to yield a diffused boron enriched surface layer at the substrate surface 12a. However, the Group IV specimens were heated sufficiently to form a uniform exposed molten layer on the substrate surface at the onset of spray casting whereas the Group III specimens were not so heated and did not develop the uniform exposed molten layer. The specimens of Group V were treated similarly to the Group IV specimens but the substrate surface was knurled prior to being boronized; e.g., the specimens had a 0.04 in.×0.04 in.×0.04 in. (0.10 cm×0.10 cm×0.10 cm) pyramidal knurl pattern, FIG. 6. Specimens of Groups VI and VII were both vacuum cleaned and boronized in accordance with the surface treatments (a) and (b) set forth above. However, the Group VI specimens were heated sufficiently to form the exposed molten layer on the substrate surface at the onset of spray casting whereas the Group VII specimens were not so heated.

TABLE I

VPSD LC Astroloy to Cast Mar-M247
Flat Plate Bond Data

| Mar-M247 Surface Prep Method | Sample | Test Parameters | Individual Bar Data Life (hrs) | % EL | % RA | Average Data Life $\bar{x}/\sqrt{n-1}$ | % EL $\bar{x}/\sqrt{n-1}$ | % RA $\bar{x}/\sqrt{n-1}$ | Fracture Comments |
|---|---|---|---|---|---|---|---|---|---|
| I Vapor Honed Only | 1876/1878 | 1400° F./80 ksi | 21.5 | 1.6 | 1.2 | | | | Bond Line Failure |
| (No Boronizing, | | | 23.7 | 2.0 | 1.3 | 20.8/5.7 | 1.9/0.2 | 1.9/0.8 | Bond Line Failure |
| No Vac Clean, | | | 12.6 | 1.8 | 2.4 | | | | Bond Line Failure |
| No Molten Layer, | | | 25.3 | 2.0 | 2.7 | | | | Bond Line Failure |
| No Knurls) | | | | | | | | | |
| II Vacuum Cleaned | 1911 | 1400° F./80 ksi | 33.7 | 2.5 | 5.6 | | | | Bond Line Failure |
| Only | | | 30.9 | 1.8 | 5.1 | 32.1/1.4 | 2.0/0.4 | 5.2/0.4 | Bond Line Failure |
| (No Boronizing, | | | 31.8 | 1.8 | 4.8 | | | | Bond Line Failure |
| No Molten Layer, | | | | | | | | | |
| No Knurls) | | | | | | | | | |
| III Boronized Only | 1906 | 1400° F./80 ksi | 25.3 | 1.1 | 2.1 | | | | Bond Line Failure |
| (No Molten Layer) | | | 27.3 | 1.6 | 3.5 | 26.8/1.3 | 1.7/0.7 | 2.7/0.7 | Bond Line Failure |
| | | | 27.7 | 2.5 | 2.4 | | | | Bond Line Failure |
| IV Boronized + | 1921 | 1400° F./80 ksi | 50.5 | 3.1 | 4.0 | | | | Mixed Mode |
| Molten Layer | | | | | | | | | Failure |
| (No Vac Cleaning, | | | 54.9 | 2.9 | 10.6 | 56.1/6.2 | 3.0/0.1 | 7.3/3.3 | Parent Metal |
| No Knurling) | | | | | | | | | Failure |
| | | | 62.8 | 2.9 | 7.4 | | | | Mixed Mode |
| | | | | | | | | | Failure |
| V Knurling + | 1922 | 1400° F./80 ksi | 72.2 | 6.6 | 5.1 | | | | Mixed Mode |
| Boronizing + | | | | | | | | | Failure |

TABLE I-continued

VPSD LC Astroloy to Cast Mar-M247
Flat Plate Bond Data

| Mar-M247 Surface Prep Method | Sample | Test Parameters | Individual Bar Data Life (hrs) | % EL | % RA | Average Data Life $\bar{x}/\sqrt{n-1}$ | % EL $\bar{x}/\sqrt{n-1}$ | % RA $\bar{x}/\sqrt{n-1}$ | Fracture Comments |
|---|---|---|---|---|---|---|---|---|---|
| Molten Layer (No Vac Cleaning) | | | 56.8 | 7.8 | 16.4 | 67.2/9.0 | 8.2/1.9 | 12.9/6.8 | Parent Metal Failure |
| | | | 72.7 | 10.3 | 17.4 | | | | Parent Metal Failure |
| VI Vacuum Clean + Boronized + | 1973 | 1400° F./80 ksi | 42.9 | 4.7 | 13.7 | | | | Parent Metal Failure |
| Molten Layer (No knurls) | | | 67.2 | 4.0 | 5.0 | 59.5/14.4 | 5.2/1.5 | 9.5/4.4 | Mixed Mode Failure |
| | | | 68.3 | 6.9 | 9.9 | | | | Parent Metal Failure |
| VII Vacuum Clean + Boronize | 1959 | 1400° F./80 ksi | 19.1 | 2.0 | 0.4 | 19.4/0.4 | 1.6/0.6 | 1.3/1.3 | Bond Line Failure |
| (No Molten Layer, No Knurls) | | | 19.6 | 1.1 | 2.2 | | | | Bond Line Failure |

Note:
El is elongation, RA is reduction in area, $\bar{x}$ is an average, $\sqrt{n-1}$ is sample standard deviation From Table I, it can be seen by comparing surface treatments I and II that the vacuum cleaning treatment by itself results in improvements in metallurgical diffusion bond joint strength properties. A comparison of surface treatments I and III reveals a slight improvement in diffusion bond joint properties resulting from heating the boronized substrate without formation of an exposed molten surface layer. However, from a comparison of surface treatments II and III, it is evident that the vacuum cleaning treatment by itself provides better metallurgical diffusion bond joint properties than heating the boronized substrate without molten layer formation.

The effect of heating the boronized substrate surface 12*a* such that a uniform exposed molten metal layer is formed on the substrate surface at the onset of spray casting is shown by comparing surface treatments I, III and IV. It is apparent that the boronizing treatment with subsequent in-situ development of the molten layer on the substrate surface at the onset of spray casting results in better metallurgical diffusion bond joint properties than untreated substrates or boronized substrates where no exposed molten layer was subsequently developed on the substrate. Moreover, substrate surface texturing (e.g., knurling the substrate surface) prior to the boronizing surface treatment with development of the exposed molten layer yields further improvements in diffusion bond joint properties as illustrated by a comparison of surface treatments IV and V.

The criticality of developing the exposed molten layer on the substrate surface at the onset of spray casting in improving diffusion bond joint properties is confirmed by comparing surface treatments III, VI and VII. It is apparent that development of the exposed molten layer on the substrate surface at the onset of spray casting significantly improves the bond joint properties.

Figure 5:
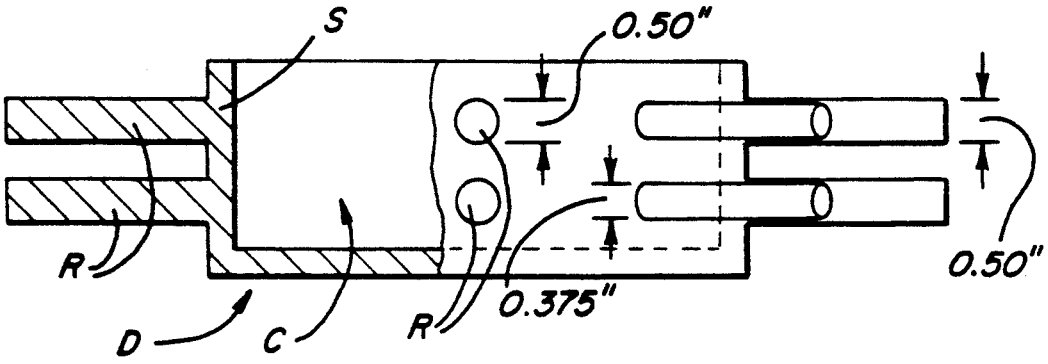
FIG. 5 is side elevation, partially broken away, of a spoked dish-shaped specimen (i.e., a pseudo turbine wheel test specimen) in which the spray cast deposit is received.

Another set of tests was conducted using so-called "dish" or "pseudo rotor" specimens D, FIG. 5, in lieu of the flat plate specimens described hereinabove. The "dish" specimen used is shown in FIG. 5 and had the following dimensions, 5.25 inches OD×4.75 inches ID×1.75 inches depth (13.34 cm OD×12.07 cm ID×4.45 cm depth) with eight pairs of pins or spokes R,R′ (simulating blades) extending in a radial direction from the dish sidewall S and spaced circumferentially apart around the dish sidewall S, FIG. 5. Four pairs of the pins R are 0.50 inch (1.27 cm) diameter while the other four pairs of smaller pins R′ are 0.375 inch (0.95 cm) diameter in alternating sequence around the sidewall S. The pins are cast integrally with the sidewall of the dish specimen.

During low pressure, high velocity plasma spraying, each dish specimen D was positioned on a rotatable table with the sidewall S of the dish specimen extending vertically such that the cavity C could receive the spray cast deposit of LC Astroloy. Spray casting of the LC Astroloy was conducted using a spray gun oriented at 44 degrees to the dish side walls and at 46 degrees to the horizontal bottom and top lip of the dish specimen while the table was rotated. The spray gun was translated relative to the rotating dish specimen to insure build-up of a uniform deposit. All of the dish specimens were subjected to the vacuum cleaning treatment (a) and boronizing treatment (b) described above prior to placement in the spray chamber.

The dish specimens were subjected to low pressure plasma preheat (LPP), low temperature reverse clean (LTRAC) and high temperature reverse arc clean (HTRAC) procedures as described hereinabove for the plate specimens with care taken to insure a desired uniform temperature from the top to the bottom of the sidewall S during spray casting.

Table II sets forth stress rupture properties for the dish specimens. The stress rupture specimens shown in FIG. 7B were machined radially from the dish specimens D with the longitudinal axis of the stress rupture specimens coaxial to the axis of one of the large or small pins R,R′ adjacent the top or bottom of the sidewall S such that bond joint J was normal to the longitudinal axis of the stress rupture specimen.

TABLE II

VPSD LC Astroloy to Cast Mar-M247 Pseudo Rotor (Dish Specimen) Bond Data

| Mar-M247 Surface Prep Method | Sample | Test Parameters | Individual Bar Data Life (hrs) | % EL | % RA | Average Data Life $\bar{x}/\sqrt{n-1}$ | % EL $\bar{x}/\sqrt{n-1}$ | % RA $\bar{x}/\sqrt{n-1}$ | Fracture Comments |
|---|---|---|---|---|---|---|---|---|---|
| I Vapor Honed Only | 2013 | 1400° F./80 ksi | 31.1 | 1.9 | 2.1 | | | | Bond Line Failure |
| (No Boron, | | | 20.2 | 1.0 | 0.5 | 25.9/4.6 | 1.6/0.5 | 1.4/0.7 | Bond Line Failure |
| No Vac Clean, | | | 27.7 | 1.4 | 1.9 | | | | Bond Line Failure |
| No Molten Layer, | | | 24.9 | 2.0 | 1.2 | | | | Bond Line Failure |
| No Knurls) | | | | | | | | | |
| II Vacuum Cleaned | 1929 | 1400° F./80 ksi | 24.8 | 1.8 | 5.1 | | | | Bond Line Failure |
| Only | | | 23.2 | 1.6 | 2.5 | 24.1/0.8 | 1.5/0.3 | 3.2/1.7 | Bond Line Failure |
| (No Boron, | | | 24.2 | 1.2 | 2.0 | | | | Bond Line Failure |
| No Molten Layer, | | | | | | | | | |
| No Knurls) | | | | | | | | | |
| III Boronized Only | 1947 | 1400° F./80 ksi | 29.6 | 1.2 | 1.7 | 29.5/0.2 | 2.8/2.2 | 6.9/7.3 | Bond Line Failure |
| (No Molten Layer, | | | 29.3 | 4.3 | 12.0 | | | | Parent Metal Failure |
| No Knurls) | | | | | | | | | |
| IV Knurling + | 2014 | 1400° F./80 ksi | 50.6 | 5.6 | 16.8 | | | | Parent Metal Failure |
| Vac Cleaning + | | | | | | | | | |
| Boronizing + Molten | | | 88.5 | 5.9 | 14.9 | 64.5/18.6 | 5.1/1.4 | 16.2/1.2 | Parent Metal Failure |
| Layer | | | | | | | | | |
| | | | 48.9 | 3.0 | 15.5 | | | | Parent Metal Failure |
| | | | 69.8 | 5.9 | 17.5 | | | | Parent Metal Failure |
| V Vacuum Clean + | 2016 | 1400° F./80 ksi | 48.9 | 5.7 | 15.0 | | | | Parent Metal Failure |
| Boronized + | | | | | | | | | |
| Molten Layer | | | 57.3 | 5.5 | 10.2 | 57.4/6.0 | 6.0/0.6 | 14.1/2.6 | Parent Metal Failure |
| (No knurls) | | | | | | | | | |
| | | | 60.7 | 6.8 | 15.9 | | | | Parent Metal Failure |
| | | | 62.5 | 6.0 | 15.2 | | | | Parent Metal Failure |

Note:
El is elongation, RA is reduction in area, $\bar{x}$ is an average, $\sqrt{n-1}$ is sample standard deviation From Table II, it can be seen by comparing surface treatments I through III and V that the combination of the vacuum cleaning treatment followed by the boronizing treatment with subsequent development of the molten layer on the substrate surface 12a at the onset of spray casting results in a significantly improved metallurgical diffusion bond joint as compared to the bond joints produced using the vapor honed treatment (Group I), the vacuum cleaning treatment (Group II) or the boronizing treatment (Group III) where no exposed molten layer was developed in-situ on the substrate surface at the onset of spraying. Moreover, by comparing surface treatment IV with the other treatments, it is apparent that initial substrate surface texturing (i.e., knurling the substrate surface) in combination with the vacuum cleaning treatment followed by the boronizing treatment with the subsequent development of the molten layer on the substrate surface at the onset of low pressure plasma spraying yielded further improvements in the properties of the metallurgical diffusion bond joint. Importantly, the Groups IV and V exhibited epitaxial grain growth across the diffusion bond joint after HIP and produced parent metal failures in the samples tested.

Figure 7B:
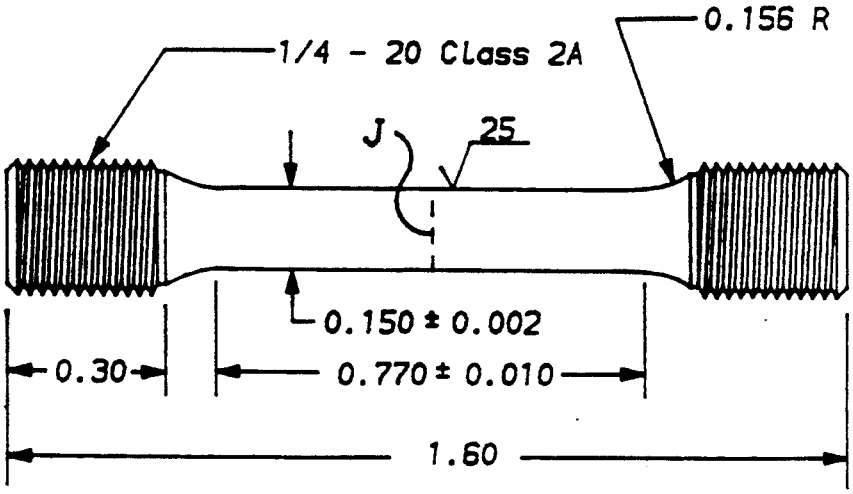

Table III reveals the results of 1400° F./80 KSI stress rupture tests of stress rupture specimens, FIG. 7B, machined from LC Astroloy/IN713LC dish specimens where LC Astroloy was spray cast in an IN713LC dish specimen, FIG. 5 which had been vacuum cleaned, boronized, preheated and HT RAC'ed to develop a molten layer at the onset of spray casting as explained hereinabove. After spray casting, these dish specimens were hot isostatically pressed at 2225° F. at 15 KSI for 4 hours and then heat treated as described hereinabove for the plate specimens of Table I.

Six stress rupture bar specimens were tested from sample 2001 while four stress rupture bar specimens were tested from each of samples 2021 and 2022.

TABLE III

VPSD LC Astroloy To Cast IN713LC Psuedo Rotor (Dish Specimen) Bond Data 1400° F./80 KSI Stress Rupture Properties

| Sample | Life (hrs) $\bar{x}$ | Life (hrs) $\sqrt{n-1}$ | % EL $\bar{x}$ | % EL $\sqrt{n-1}$ | % RA $\bar{x}$ | % RA $\sqrt{n-1}$ | Fracture Comments |
|---|---|---|---|---|---|---|---|
| 2001 | 40.7 | 3.6 | 7.1 | 0.9 | 15.3 | 1.9 | All Parent Metal Failure |
| 2021 | 62.0 | 7.2 | 8.1 | 0.7 | 14.3 | 3.8 | All Parent Metal Failure |
| 2022 | 56.0 | 1.7 | 8.4 | 0.4 | 19.4 | 1.7 | All Parent Metal Failure |

Note:
EL is elongation, RA is reduction in area, $\bar{x}$ is an average, $\sqrt{n-1}$ is sample standard deviation Again, subjecting the substrate surface to surface treatments (a) and (b) with the development of the uniform molten layer on the sidewall S (from top to bottom thereof) at the onset of spray casting in conjunction with subsequent hot isostatic pressing was effective to significantly enhance the structural integrity of the bond joint formed. The samples exhibited epitaxial grain growth across the diffusion bond joint after HIP and failures exclusively in the parent metal.

In practicing the present invention, the presence of epitaxial grain growth across the diffusion bond joint after HIP is preferred to further enhance bond structural integrity as evidenced by parent metal failures in the stress rupture tests.

As mentioned hereinabove, different substrate surface treatments have been discovered to have different effects on the diffusion bond joint properties of the spray cast specimens depending upon the similarity or dissimilarity of the compositions of the substrate metal and the spray cast metal. The examples set forth hereinabove illustrate the effect for dissimilar compositions (i.e., LC Astroloy on investment cast Mar-M247 and IN713LC). The examples set forth hereinbelow illustrate the effect for similar compositions (i.e., LC Astroloy on LC Astroloy).

Testing Of Similar Compositions

In these tests, the substrate comprised a flat, square plate of nominal 2 inches (5 cm) width, 2 inches (5 cm) length and ¾ inch (1.9 cm) thickness. The LC Astroloy substrate plate was formed by spray casting and hot isostatic pressing, but not bonding to any other substrate, under the same conditions as described hereinafter for the specimens. Specimens were prepared to investigate the effect of vacuum cleaning of the substrate surface on the structural integrity of the bond joint of the structural spray cast specimen. The vacuum cleaning treatment (as well as preheating and reverse arc cleaning) used to prepare the specimens was similar to that set forth above for the plate specimens of dissimilar composition. The vacuum cleaned specimens were compared against similar specimens which were vapor honed prior to preheating and reverse arc cleaning. The LC Astroloy was spray cast onto the LC Astroloy substrate plate to a thickness of about ¾ inch (1.9 cm) using the same technique employed for spray casting the Mar-M247 on LC Astroloy.

After cooling, the spray cast preforms were hot isostatically pressed at 2165° F. and 25 KSI for 4 hours. Thereafter, the preforms were subjected to the same heat treatment described above for the plate specimens of dissimilar composition.

Table IV sets forth 1400° F./80 ksi stress rupture test results for the surface treatments investigated. The configuration of the stress rupture specimens is shown in FIG. 7A.

TABLE IV

VPSD LC Astroloy to VPSD LC Astroloy Flat Plate Bond Data

| Astroloy Surface Prep Method | Sample ID | Test Parameters | Individual Bar Data Life (hrs) | Individual Bar Data % EL | Individual Bar Data % RA | Average Data Life $\bar{x}/\sqrt{n-1}$ | Average Data % EL $\bar{x}/\sqrt{n-1}$ | Average Data % RA $\bar{x}/\sqrt{n-1}$ | Fracture Comments |
|---|---|---|---|---|---|---|---|---|---|
| Vapor Honed Only | 1899 | 1400° F./80 ksi | 1.6 | 0.7 | 2.7 | | | | Planar Interface |
| (No Boron, | | | 15.0 | 1.3 | 1.2 | 10.6/6.2 | 1.3/0.5 | 1.6/0.9 | Planar Interface |
| No Vac Cleaning, | | | 11.9 | 1.3 | 1.8 | | | | Planar Interface |
| No Molten Layer, | | | 14.0 | 1.8 | 0.7 | | | | Planar Interface |
| No Knurls) | | | | | | | | | |
| Vacuum Cleaned Only | 1927 | 1400° F./80 ksi | 59.1 | 8.8 | 7.1 | | | | Bond Failure |
| (No Boron, | | | 56.4 | 8.8 | 17.4 | 57.9/1.4 | 8.5/0.5 | 10.5/6.0 | Parent Metal |
| No Molten Layer, | | | 58.4 | 8.0 | 6.9 | | | | Bond Failure |
| No Knurls) | | | | | | | | | |

Note:
EL is elongation, RA is reduction is area, $\bar{x}$ is an average, $\sqrt{n-1}$ is sample standard deviation Table IV demonstrates that the structural integrity of the bond joint between similar compositions of the substrate metal and the spray cast deposit can be enhanced by applying the vacuum cleaning surface treatment to the substrate surface prior to metal spray casting. The improvement with the vacuum cleaning treatment alone is believed to be due to the removal from the plate surface of certain tramp elements (mentioned hereinabove) which are deleterious to formation of a satisfactory metallurgical diffusion bond joint; i.e., a metallurgical diffusion bond joint which does not exhibit failure solely along the joint.

In summary, the enhancement of diffusion bond joint integrity of structural spray cast articles as measured by stress rupture tests can be significantly improved by the application of the above discussed surface treatment processes (a)–(d) to the substrate 10 prior to deposition of the spray cast metal 11 and metallurgical diffusion bonding. In addition, the invention recognizes that the compositional difference between the materials of the substrate and the spray cast will impact the surface treatment processes necessary to enhance the bond joint integrity.

Although this invention has been shown and described with respect to a preferred embodiment, it will be understood by those skilled in the art that various changes in form and detail thereof may be made without departing from the spirit and scope of the claimed invention.

We claim:

1. In a method of making a structural article having a diffusion bond joint between a solid metal substrate constituting a first structural component of the article having selected mechanical properties and a solidified spray cast deposit thereon constituting a second structural component of the article having different mechanical properties, the improvement for increasing the structural integrity of the bond joint in sustaining a load across the joint, comprising the steps of:

(a) providing the solid metal substrate with a surface for receiving the deposit, (b) heating said surface in the presence of a fluxing and melting point depressant agent at said surface to form an exposed in-situ liquid layer on said surface at the onset of plasma spraying of molten metal thereon, (c) spraying the molten metal initially onto the exposed liquid layer to build-up the deposit on said surface, and (d) diffusion bonding the deposit and the substrate to form said structural article.

2. The method of claim 1 wherein the fluxing and melting point depressant agent is present at said surface prior to heating in step (b).

3. The method of claim 2 wherein the fluxing and melting point depressant agent comprises a boron-bearing diffusion layer at said surface.

4. The method of claim 1 wherein said surface is heated in step (b) by impinging a thermal plasma thereon.

5. The method of claim 4 wherein said surface is cleaned by reverse arc cleaning after impinging the thermal plasma thereon and immediately prior to the onset of spraying of the molten metal onto said liquid phase.

6. The method of claim 4 or 5 wherein the substrate is a nickel base superalloy heated to at least about 2000° F.

7. The method of claim 1 including hot isostatically pressing the deposit and the substrate in step (d) to effect diffusion bonding therebetween.

8. The method of claim 7 including effecting epitaxial grain growth across the diffusion bond between said deposit and said substrate.

9. The method of claim 2 wherein said surface is vacuum cleaned prior to providing the melting point depressant at said surface, said surface being vacuum cleaned by exposing said surface at elevated temperature to a vacuum of at least about $10^{-4}$ torr.

10. The method of claim 2 including knurling said surface prior to providing the melting point depressant at said surface.

11. The method of claim 1 wherein the solid metal substrate and the molten metal have different compositions.

12. The method of claim 1 wherein the solid metal substrate is provided as a bladed component of a turbine or compressor rotor and the solidified spray cast deposit is provided as a hub of the turbine or compressor rotor.

13. In a method of making a structural, multi-property article having a diffusion bond joint between a metal substrate constituting a first structural component of the article having selected mechanical properties and a solidified spray cast deposit thereon constituting a second structural component of the article having different mechanical properties, the improvement for increasing the structural integrity of the bond joint in sustaining a load across the joint under elevated temperature conditions without exhibiting failure solely in said joint, comprising the steps of:

(a) providing the solid metal substrate with a surface for receiving the deposit, (b) providing a fluxing and melting point depressant agent at said surface, (c) heating said surface with the fluxing and melting point depressant agent at said surface to form an exposed in-situ liquid layer on said surface at the onset of spraying of molten metal thereon, (d) spraying the molten metal onto the exposed in-situ liquid layer to build-up the deposit on said surface, and (e) diffusion bonding the deposit and the substrate to form said structural article.

14. The method of claim 13 wherein the fluxing and melting point depressant agent comprises a boron-bearing layer at said surface.

15. The method of claim 13 wherein said surface is heated in step (c) by impinging a thermal plasma thereon.

16. The method of claim 15 wherein said surface is cleaned by reverse arc cleaning after impinging the thermal plasma thereon and immediately prior to the onset of spraying of the molten metal onto said liquid phase.

17. The method of claim 15 or 16 wherein the substrate is a nickel base superalloy heated to at least about 2000° F.

18. The method of claim 13 including hot isostatically pressing the deposit and the substrate in step (d) to effect diffusion bonding therebetween.

19. The method of claim 18 including effecting epitaxial grain growth across the diffusion bond between said substrate and said deposit.

20. The method of claim 13 wherein said surface is vacuum cleaned prior to providing the melting point depressant at said surface, said surface being vacuum cleaned by exposing said surface at elevated temperature to a vacuum of at least about $10^{-4}$ torr.

21. The method of claim 13 wherein the metal substrate and the spray deposit have different compositions.

22. The method of claim 13 wherein the substrate comprises a single crystal metal member.

23. The method of claim 13 wherein the substrate comprises a directionally solidified columnar grain metal member.

24. The method of claim 13 wherein the substrate comprises an equiaxed grain member.

25. The method of claim 13 wherein the deposit has a low cycle fatigue resistant microstructure and the substrate has a creep resistant microstructure.

26. The method of claim 25 wherein the deposit has a fine grain microstructure.

27. The method of claim 13 including knurling the surface prior to step (b).

28. In a method of making a structural, multi-alloy, rotary article having a rotational axis and a diffusion bond joint between a creep resistant superalloy substrate constituting a first peripheral structural component of the article and a low cycle fatigue resistant solidified spray cast superalloy deposit constituting a second central structural component of the article, the improvement for increasing the structural integrity of the bond joint in sustaining a radial load across the joint under elevated temperature creep conditions without exhibiting failure solely in said joint, comprising the steps of:

(a) providing the superalloy substrate with a surface of revolution relative to said axis for receiving the deposit, (b) providing a fluxing and melting point depressant agent at said surface, (c) heating said surface with the fluxing and melting point depressant agent at said surface and reverse arc cleaning the heated surface to form an exposed in-situ liquid layer on the surface at the onset of spraying of molten metal thereon, (d) spraying the molten metal onto the exposed in-situ liquid layer to build-up said superalloy deposit on said surface, and (e) diffusion bonding the deposit and the substrate to form said structural article.

29. The method of claim 28 wherein the substrate is a single crystal superalloy member.

30. The method of claim 28 wherein the substrate is a directionally solidified columnar grain superalloy member.

31. The method of claim 28 wherein the substrate is an equiaxed grain superalloy member.

32. The method of claim 28 including effecting epitaxial grain growth across the diffusion bond formed in step (e).

33. The method of claim 28 wherein the substrate is cast to have the surface of revolution.

34. The method of claim 33 wherein the substrate is cast to have a cylindrical surface of revolution.

35. In a method of making a multi-alloy bladed turbine or compressor rotor having a rotational axis and a diffusion bond joint between a creep resistant superalloy bladed ring and a low cycle fatigue resistant solidified spray cast superalloy hub, the improvement for increasing the structural integrity of the bond joint in sustaining a radial load across the joint under elevated temperature creep conditions without exhibiting failure solely in said joint, comprising the steps of:

(a) casting the superalloy bladed ring to have a surface of revolution relative to said axis for receiving the deposit, (b) providing a fluxing and melting point depressant agent at said surface, (c) eating said surface with the fluxing and melting point depressant agent at said surface to form an exposed in-situ liquid layer uniformly across the surface at the onset of spraying of molten metal thereon, (d) spraying the molten metal onto the exposed in-situ liquid layer to build-up said superalloy deposit on said surface, and (e) diffusion bonding the deposit and the substrate to form said structural article.

36. In a method of making a structural article having a diffusion bond joint between a solid metal substrate constituting a first structural component of the article having selected mechanical properties and a solidified spray cast deposit thereon constituting a second structural component of the article having different mechanical properties, the improvement for increasing the structural integrity of the bond joint in sustaining a load across the joint, comprising the steps of:

(a) providing the solid metal substrate with a performed surface for receiving the deposit, (b) vacuum cleaning the substrate surface at elevated temperature, (c) boronizing the vacuum cleaned substrate surface, (d) plasma heating the boronized substrate surface, (e) reverse arc cleaning the preheated, boronized substrate surface and forming an exposed in-situ liquid layer on said surface at the onset of plasma spraying of molten metal thereon, (f) spraying the molten metal initially onto the exposed liquid layer to build-up the deposit on said surface, and (g) diffusion bonding the deposit and the substrate to form said structural article.

37. In a method of making a structural, multi-alloy, rotary article having a rotational axis and a diffusion bond joint between a creep resistant superalloy substrate constituting a first peripheral structural component of the article and a low cycle fatigue resistant solidified spray cast superalloy deposit constituting a second central structural component of the article, the improvement for increasing the structural integrity of the bond joint in sustaining a radial load across the joint under elevated temperature creep conditions without exhibiting failure solely in said joint, comprising the steps of:

(a) providing the superalloy substrate with a performed surface of revolution relative to said axis for receiving the deposit, (b) vacuum cleaning the substrate surface at elevated temperature, (c) boronizing the vacuum cleaning substrate surface, (d) plasma heating the boronized substrate surface, (e) reverse arc cleaning the preheated, boronized substrate and forming an exposed in-situ liquid layer on the surface at the onset of spraying of molten metal thereon, (f) spraying the molten metal onto the exposed in-situ liquid layer to build-up said superalloy deposit on said surface, and (g) diffusion bonding the deposit and the substrate to form said structural article.

* * * * *